US012201892B2

(12) United States Patent
Pulsifer et al.

(10) Patent No.: US 12,201,892 B2
(45) Date of Patent: Jan. 21, 2025

(54) SYSTEMS, APPARATUSES, AND METHODS FOR FASTENERS IN BOARD SPORTS

(71) Applicant: MESA DISTRIBUTION, INC., Los Alamitos, CA (US)

(72) Inventors: Joseph Pulsifer, Atascadero, CA (US); Yuche Su, Taipei (TW)

(73) Assignee: Mesa Distribution, Inc., Los Alamitos, CA (US)

( * ) Notice: Subject to any disclaimer, the term of this patent is extended or adjusted under 35 U.S.C. 154(b) by 323 days.

(21) Appl. No.: 17/900,291

(22) Filed: Aug. 31, 2022

(65) Prior Publication Data

US 2024/0066383 A1 Feb. 29, 2024

(51) Int. Cl.
*A63C 17/01* (2006.01)

(52) U.S. Cl.
CPC ..... *A63C 17/015* (2013.01); *A63C 17/012* (2013.01)

(58) Field of Classification Search
CPC ..... A63C 17/012; A63C 17/015
See application file for complete search history.

(56) References Cited

U.S. PATENT DOCUMENTS

| | | | | |
|---|---|---|---|---|
| 5,169,166 | A * | 12/1992 | Brooks | A63C 17/013 280/100 |
| 7,237,784 | B1 * | 7/2007 | Monteleone | A63C 17/01 280/87.03 |
| 7,722,060 | B1 * | 5/2010 | Clark | A63C 17/0093 280/11.27 |
| 10,695,655 | B1 * | 6/2020 | Chung | A63C 17/0093 |
| 2015/0130156 | A1 * | 5/2015 | Docter | A63C 17/0093 280/124.114 |
| 2016/0059108 | A1 * | 3/2016 | Demolder | A63C 17/12 701/22 |
| 2018/0193721 | A1 * | 7/2018 | Martinez Almansa | A63C 17/015 |
| 2018/0296906 | A1 * | 10/2018 | Quick | B60B 27/0015 |
| 2020/0030684 | A1 * | 1/2020 | Corvello | A63C 17/262 |
| 2024/0066383 | A1 * | 2/2024 | Pulsifer | A63C 17/015 |
| 2024/0115926 | A1 * | 4/2024 | Su | A63C 17/0093 |

* cited by examiner

*Primary Examiner* — Erez Gurari
(74) *Attorney, Agent, or Firm* — Snell & Wilmer LLP

(57) ABSTRACT

Systems, apparatuses, and methods for fastening components of equipment, specifically a skateboard, among other types of sporting boards or sports apparatuses or wheeled sporting apparatuses. Fastening systems disclosed herein may be utilized to couple a deck of a skateboard to a truck of a skateboard. The fastening systems may reduce the need for a tool (e.g., a hex drive or other tool) that might typically be utilized to engage a head of a fastener to hold the fastener in place while a securement body (e.g., a nut) is coupled to the fastener.

20 Claims, 10 Drawing Sheets

SYSTEMS, APPARATUSES, AND METHODS FOR FASTENERS IN BOARD SPORTS

BACKGROUND

Skateboarding or board sports in general are popular activities performed by individuals with a wide range of interests and athletic abilities. Interest in such activities has increased over the past decades, with expansion of interest in board sports extending to a variety of demographics. Hobbyists as well as professionals may perform such activities for recreation, transportation, or in competitive endeavors (e.g., contests).

Equipment is generally required to perform such activities, generally comprising the sporting board (e.g, the skateboard itself) and any pertinent accessories (e.g., a helmet or other safety equipment). Such equipment may be utilized to construct and maintain the sporting board as well. Increased interest in such activities has increased the need for improved components for such equipment.

SUMMARY

Systems, apparatuses, and methods disclosed herein may be directed to improvements in the field of board sports, or sporting boards, or more particularly skateboarding. Increased interest in such activities has increased the need for improved equipment for such endeavors, including the increased ability to repair equipment in the field, as well as to modify such equipment as desired. Improved ease of fastening of components of such equipment is desired, as well as improved ease of manufacture of such equipment.

Generally disclosed herein are fastening systems for fastening components of equipment, specifically a skateboard, among other types of sporting boards or sports apparatuses or wheeled sporting apparatuses. Fastening systems disclosed herein may be utilized to couple a deck of a skateboard to a truck of a skateboard. The fastening systems may reduce the need for a tool (e.g., a hex drive or other tool) that might typically be utilized to engage a head of a fastener to hold the fastener in place while a securement body (e.g., a nut) is coupled to the fastener. The fastening systems disclosed herein may utilize one or more grip features that may grip the head of the fastener to the deck to reduce the need for such a tool (e.g., a hex drive or other tool).

The fastening systems disclosed herein may improve the ability of a skateboard to be repaired or modified in the field, by reducing the amount of equipment that a user (e.g., a rider) must carry in the field. For example, a user would not necessarily be required to carry a tool (e.g., a hex drive or other tool) for engaging the head of the fastener in the field for repair or modification. Further, improved ease (e.g., speed, reduction of effort) of fastening may be provided. In addition, improvements in manufacture of a skateboard may be provided due to the reduced number of tools required to assemble a skateboard.

The fastening systems disclosed herein may be packaged and provided solely as at least one fastener for being used with a skateboard. For example, one or more fasteners of a skateboard may be removed and replaced with one or more of the fasteners as disclosed herein. In addition, a skateboard system may be provided that may include one or more of the fasteners disclosed herein. For example, a skateboard system may include a pre-assembled skateboard or may comprise components of a skateboard for a user to assemble.

In aspects, a skateboard system. The skateboard system may include a deck.

The skateboard system may include a plurality of wheels. The skateboard system may include a plurality of trucks configured to support the plurality of wheels.

The skateboard system may include a plurality of fasteners configured to couple the plurality of trucks to the deck, at least one of the fasteners including a head and a shaft, the head including a bearing surface and one or more grip features configured to grip the head to the deck, the shaft configured to couple to one of the plurality of trucks.

In aspects, a skateboard fastener system.

The skateboard fastener system may include at least one fastener configured to couple a deck of a skateboard to a truck of the skateboard, the at least one fastener including a head and a shaft, the head including a bearing surface and one or more grip features configured to grip the head to the deck, the shaft configured to couple to the truck.

In aspects, a method comprising providing at least one fastener configured to couple a deck of a skateboard to a truck of the skateboard, the at least one fastener including a head and a shaft, the head including a bearing surface and one or more grip features configured to grip the head to the deck, the shaft configured to couple to the truck.

DETAILED DESCRIPTION

Figure 1:
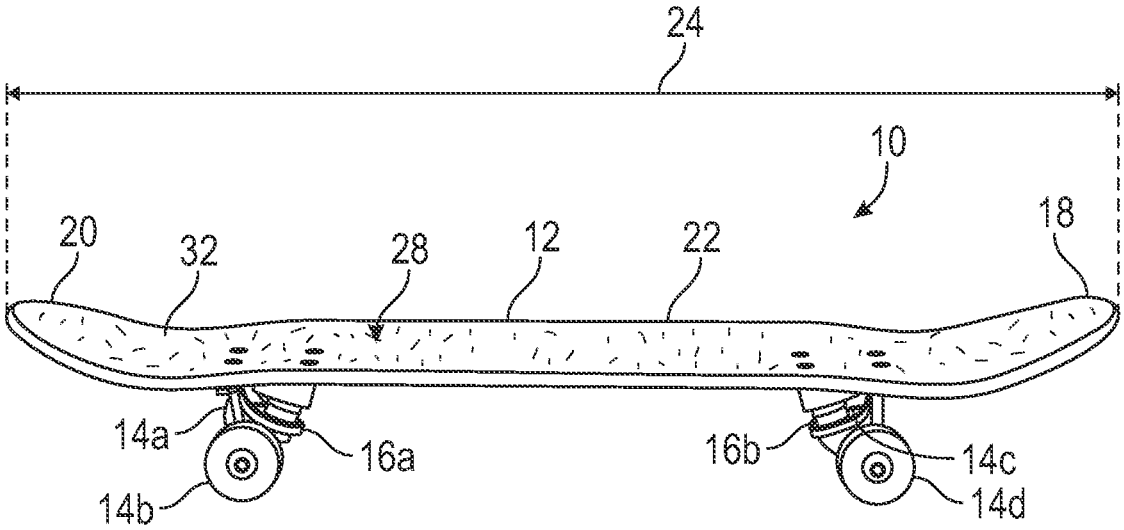
FIG. 1 illustrates a side view of a skateboard system according to examples herein.

FIG. 1 illustrates an exemplary skateboard system 10 that may be utilized in examples herein. The skateboard system 10 may include a deck 12, a plurality of wheels 14*a-d*, and a plurality of trucks 16*a, b* that may be configured to support the plurality of wheels 14*a-d*. In examples, the skateboard system 10 may comprise a greater or fewer number of components, or modifications of the components illustrated in FIG. 1 as desired.

The deck 12 may comprise a board of the skateboard system 10. A user (e.g., a rider) may stand upon the deck 12 to ride the skateboard and to perform a variety of tricks if desired. The deck 12 may include a nose 18 at the front of the deck 12, a tail 20 at the rear of the deck 12, and a main body 22 between the nose 18 and the tail 20. One or both of the nose 18 and the tail 20 may be angled relative to the main body 22, or may be planar with the main body 22 in examples as desired.

The deck 12 may have a length 24 and a width 26 (marked in FIG. 3), which may be varied in examples as desired.

The deck 12 may include a top surface 28 or upper surface, and a bottom surface 30 or lower surface (marked in FIG. 3) facing opposite the top surface 28. The top surface 28 in examples may be a surface for a user (e.g., a rider) to stand upon when riding the skateboard.

In examples, the top surface 28 may include a layer of grip tape 32 that may be applied to a surface 34 (marked in FIG. 12) of a board forming the deck 12. The grip tape 32 may be utilized to increase the grip of a user (e.g., a rider) upon the deck 12. The grip tape 32 may cover the entirety of the surface 34 of the board or may cover only a portion of the board.

The deck 12 may include holes 36*a-d*, 38*a-d* (marked in FIG. 3) that may be utilized to couple the deck 12 to the trucks 16*a, b*. The holes 36*a-d*, 38*a-d* may pass through the deck 12 from the top surface 28 to the bottom surface 30. A first group, or leading group, of the holes 36*a-d* may be utilized to couple to a first truck 16*b* or leading truck of the skateboard. A second group, or tailing group, of the holes 38*a-d* may be utilized to couple to a second truck 16*a* or tailing truck of the skateboard.

The first group of the holes 36*a-d* may be spaced from each other in a rectangular configuration. The position of the first group of holes 36*a-d* may correspond to the position of holes of the truck 16*b* for coupling with the deck 12. The second group of the holes 38*a-d* may similarly be positioned in a rectangular configuration and may correspond to the position of holes of the truck 16*a* for coupling with the deck 12. The first group of the holes 36*a-d* may be positioned proximate the nose 18 and the second group of the holes 38*a-d* may be positioned proximate the tail 20.

Figure 12:
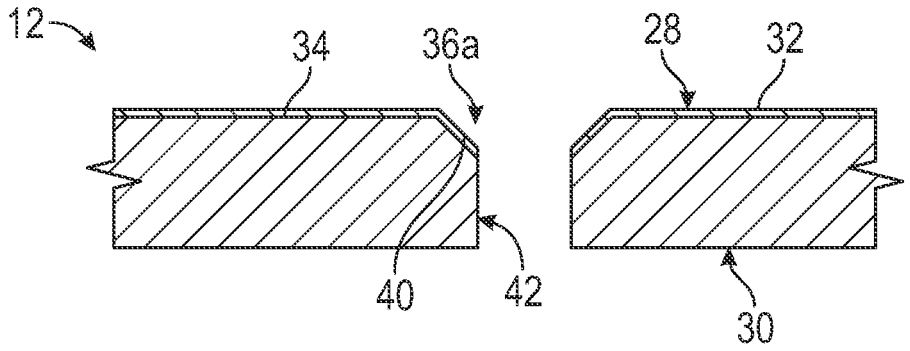
FIG. 12 illustrates a cross sectional schematic view of a deck along line A-A shown in FIG. 3.

Each of the holes 36*a-d*, 38*a-d* may include a bearing surface that may be tapered in examples. For example, FIG. 12 illustrates a cross sectional view of the deck 12 shown along line A-A in FIG. 3. A hole 36*a* may include a bearing surface 40 that may be tapered downward towards the bottom surface 30 of the deck 12. The hole 36*a* may include a cylindrical portion 42 that may be positioned between the tapered portion of the hole 36*a* and the bottom surface 30 of the deck 12. The other holes 36*b-d*, 38*a-d* may be similarly configured. In examples, the holes 36*a-d*, 38*a-d* may lack a tapered bearing surface, and the bearing surface may be planar or may have another configuration.

Figure 2:
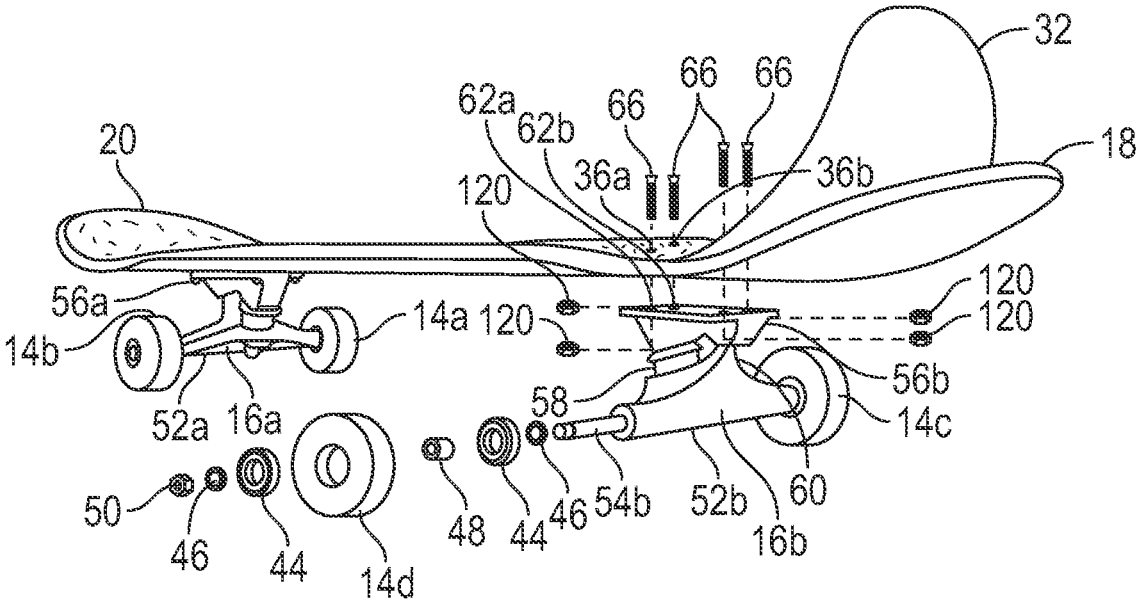
FIG. 2 illustrates a lower perspective view of a partially assembled skateboard according to examples herein.

Referring to FIG. 2, the plurality of wheels 14*a-d* may be configured to roll to provide movement of the skateboard. Each wheel 14*a-d* may be coupled to a respective truck 16*a, b* via one or more bearings 44 that may allow the wheel 14*a-d* to spin. One or more washers 46 or spacers 48 may be utilized for coupling to the respective truck 16*a, b* as well. One or more securement bodies 50 such as nuts may be utilized to couple the wheels 14*a-d* to a respective truck 16*a, b*.

The trucks 16*a, b* may be configured to support the plurality of wheels 14*a-d*. The trucks 16*a, b* may be configured to allow the plurality of wheels 14*a-d* to pivot with respect to the deck 12 to allow the skateboard to turn. Each truck 16*a, b* may include a respective truck hanger 52*a, b* that may include a respective axle 54*a, b* (marked in FIG. 4). The wheels 14*a-d* may be configured to couple to a respective axle 54*a, b* and rotate about the axle 54*a, b*.

Each truck hanger 52*a, b* may be configured to pivot relative to a respective base plate 56*a, b* to allow the wheels 14*a-d* to turn. A variety of pivot mechanisms may be utilized to allow the truck hanger 52*a, b* to pivot. As shown in FIG. 2, for example, a pivot mechanism utilizing a bushing 58, kingpin (surrounded by the bushing), and a pivot bushing 60 may be utilized. In examples, other forms of pivot mechanisms may be utilized as desired.

Figure 4:
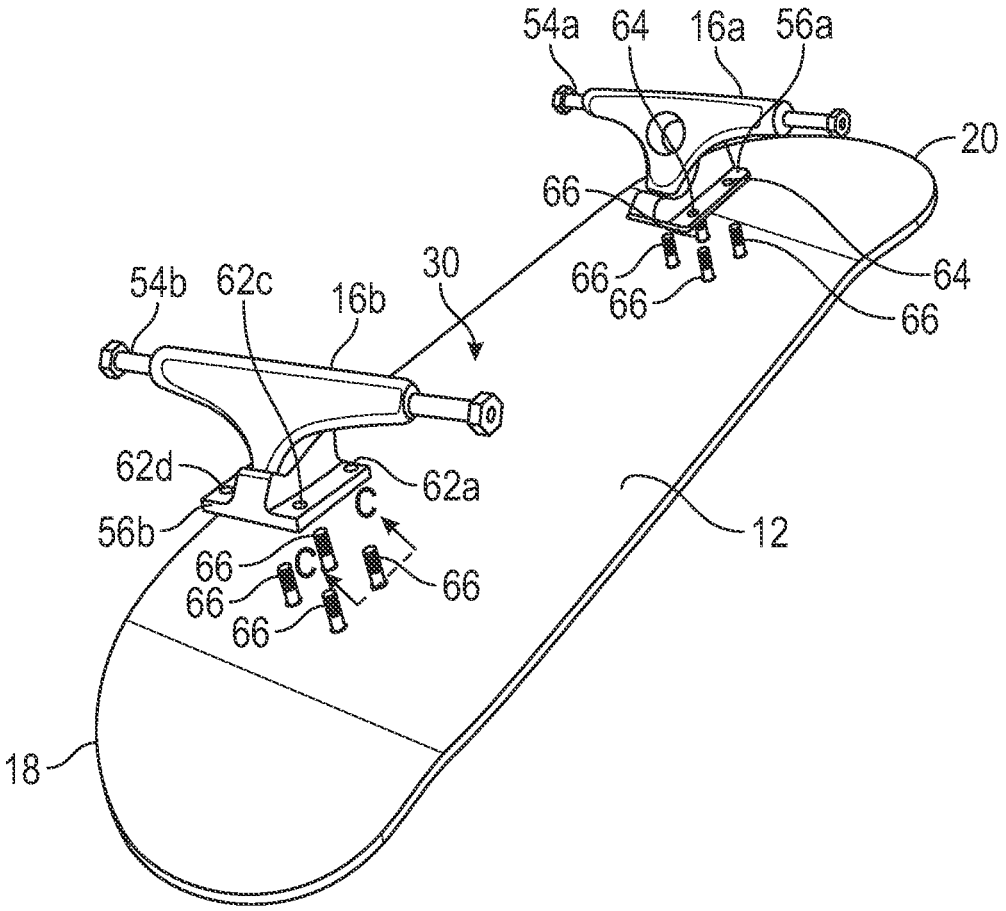
FIG. 4 illustrates a lower perspective view of the deck of the skateboard shown in FIG. 3 with fasteners protruding through the deck and trucks positioned over the fasteners.

The base plate 56*a, b* may be utilized to couple the respective truck 16*a, b* to the deck 12. The base plate 56*a, b* may comprise a flattened plate or may have other configurations as desired. The base plate 56*a, b* may be configured to be placed against the bottom surface 30 of the deck 12. Referring to FIG. 4, in examples, the base plate 56*b* may include respective holes 62*a-d*, and the base plate 56*a* may include holes 64 that may be utilized to couple the respective truck 16*a, b* to the deck 12. The holes 62*a-d*, 64 may be spaced to align with the respective holes 36*a-d*, 38*a-d* of the deck 12 and may be in a rectangular configuration as desired. In examples, other configurations may be utilized.

Figure 5:
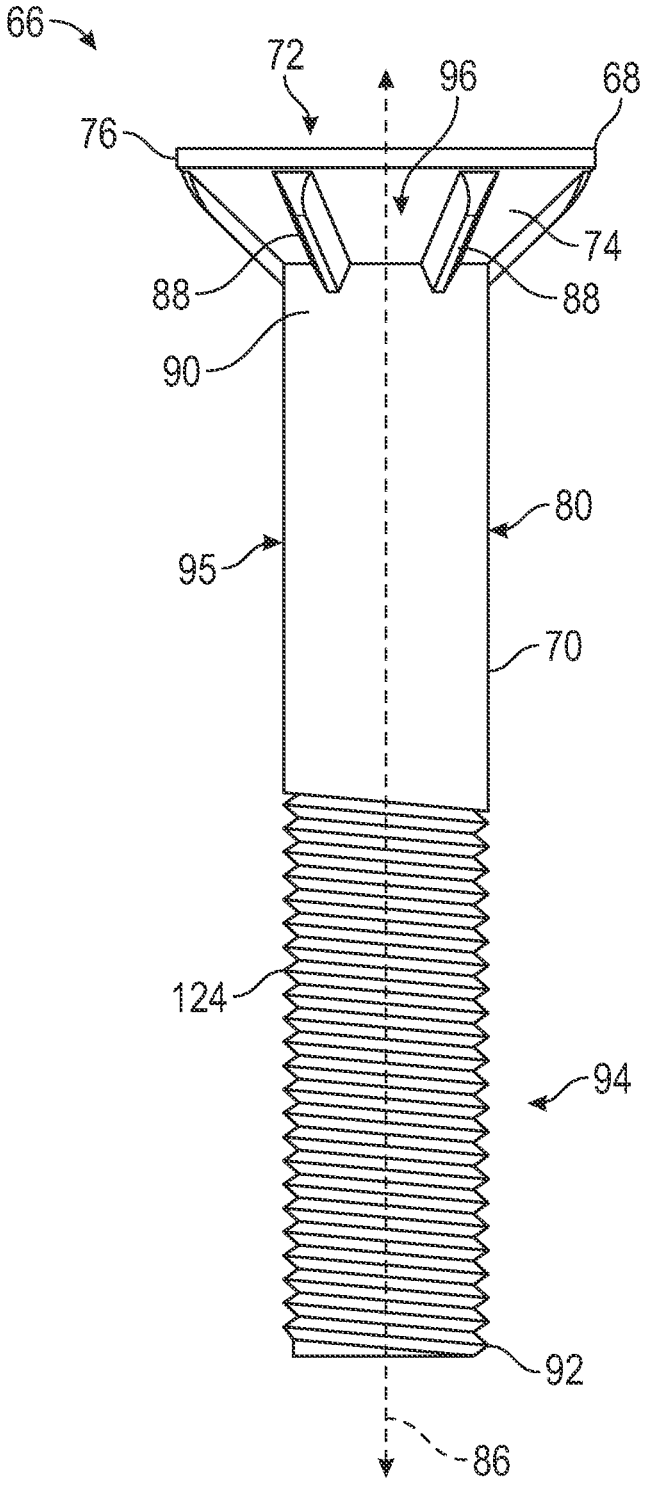
FIG. 5 illustrates a side view of a fastener according to examples herein.

A fastener system may be utilized to couple the deck 12 of the skateboard to a respective truck 16*a, b* of the skateboard. FIG. 5, for example, illustrates a fastener 66 that may comprise the system. The fastener 66 may include a head 68 and a shaft 70 in examples.

Figure 6:
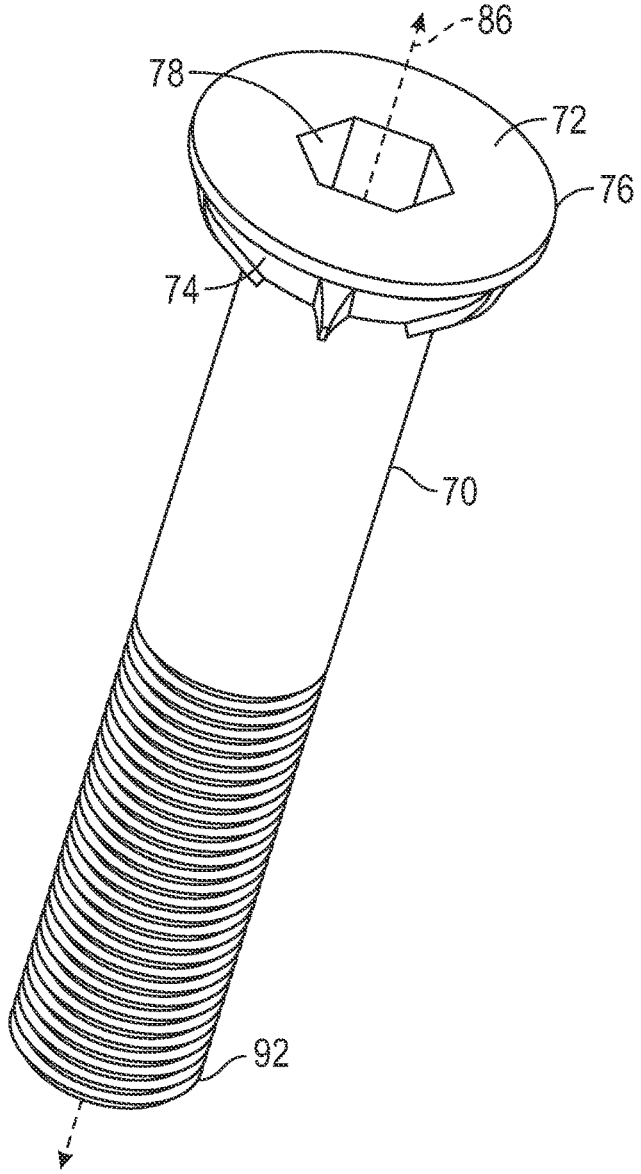
FIG. 6 illustrates a top perspective view of the fastener shown in FIG. 5.

The head 68 may include a top surface 72 (marked in FIG. 6) and may include a bearing surface 74 in examples. The top surface 72 may comprise a proximal surface or upper surface of the head 68. Referring to FIG. 6, the top surface 72 may comprise a flat surface in examples and may extend to an outer edge 76 of the top surface 72. The top surface 72 may have another configuration in examples as desired (e.g., rounded, undulating, etc.).

Figure 7:
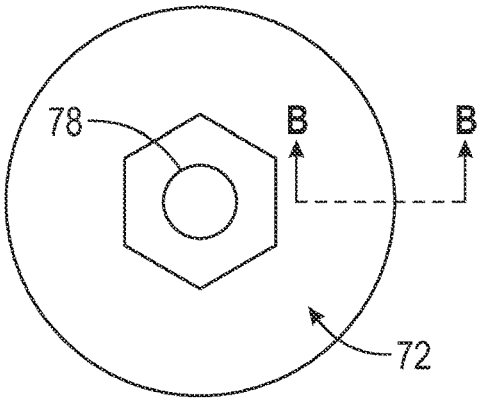
FIG. 7 illustrates a top end view of the fastener shown in FIG. 5.

The top surface 72 may have a circular outer periphery in examples, or may have another configuration as desired (e.g., hexagonal, octagonal, etc.). The top surface 72 may include a drive 78, which may comprise an aperture in the top surface 72 or may have another configuration as desired. The drive 78 may comprise a hex drive as shown in FIG. 6, or may have another configuration as desired (e.g., a flat head drive, a phillips drive, a keyed drive, etc.). FIG. 7 illustrates a top view of the top surface 72.

Figure 16:
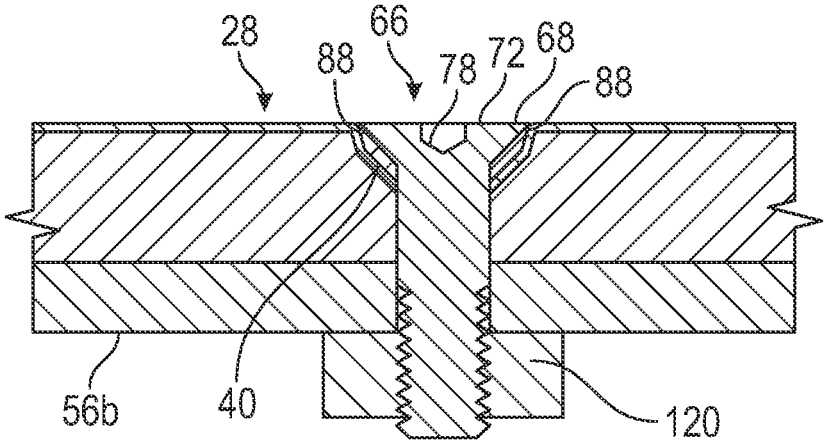
FIG. 16 illustrates a cross sectional schematic view of a fastener coupling a deck to a base plate of a truck.

In examples, the head 68 may be configured as a countersunk head, such that the top surface 72 may rest flush with the top surface 28 of the deck 12 (as shown in FIG. 16 for example).

Referring to FIG. 5, the bearing surface 74 may extend from the outer edge 76 of the top surface 72 to the outer surface 80 of the shaft 70. The bearing surface 74, in examples, may comprise a tapered surface that may taper radially inward in a distal direction such that the diameter 82 (marked in FIG. 10) of the head 68 at the shaft 70 is less than the diameter 84 (marked in FIG. 10) of the head 68 at the top surface 72 or proximal end of the head 68. The bearing surface 74 may taper inward towards a longitudinal axis 86 that the shaft 70 extends along.

The bearing surface 74 may have a constant or uniform angle from the outer edge 76 of the top surface 72 to the outer surface 80 of the shaft 70. The bearing surface 74 may extend at an angle of about 45 degrees relative to the longitudinal axis 86, or another angle as desired. In examples, the angle of the bearing surface 74 may match an angle of the bearing surface 40 of the deck 12 (marked in FIG. 12). In examples, the angle of the bearing surface 74 may differ from an angle of the bearing surface 40 of the deck 12.

The bearing surface 74 may have a conical shape, and may comprise a flat conical shape or may have a convex curvature outward from the head 68 in examples. The bearing surface 74, for example, may comprise a conical frustum. The bearing surface 74 of the head 68 may be smooth, except for the presence of grip features 88 on the bearing surface 74. The bearing surface 74 may have other configurations in examples.

The shaft 70 may extend from a proximal end 90 in a distal direction to a distal end 92. The distal end 92 may extend distally from the head 68. The proximal end 90 of the shaft 70 may be coupled to the head 68 and the distal end 92 of the shaft 70 may comprise a leading end of the shaft 70. The shaft 70 may be configured to couple to one of the trucks 16*a, b* in examples.

The shaft 70 may have a cylindrical shape surrounding the longitudinal axis 86 in examples.

In examples, a portion of the shaft 70 may include an engagement surface such as threading, and a portion of the shaft 70 may lack threading and may be smooth. For example, referring to FIG. 5, a distal portion 94 of the shaft 70 may be threaded. A proximal portion 95 of the shaft 70 may lack threading. Various other configurations of the shaft 70 may be provided. For example, in examples, the majority or entirety of the shaft 70 may be threaded as desired. In examples, a majority of the shaft 70 may be smooth. Various other configurations of the shaft and engagement surface may be provided as desired.

The fastener 66 may comprise a bolt or may have another forms in examples as desired.

The fastener 66 may include one or more grip features 88 in examples. The grip features 88 may be positioned on the head 68. The grip features 88 may be configured to grip the head 68 to the deck 12.

Referring to FIG. 5, the grip features 88 may be positioned on the bearing surface 74 of the head 68 in examples. The grip features 88, for example, may comprise protrusions that protrude from the bearing surface 74. The protrusions may protrude in a distal direction or leading direction from the bearing surface 74.

Figure 8:
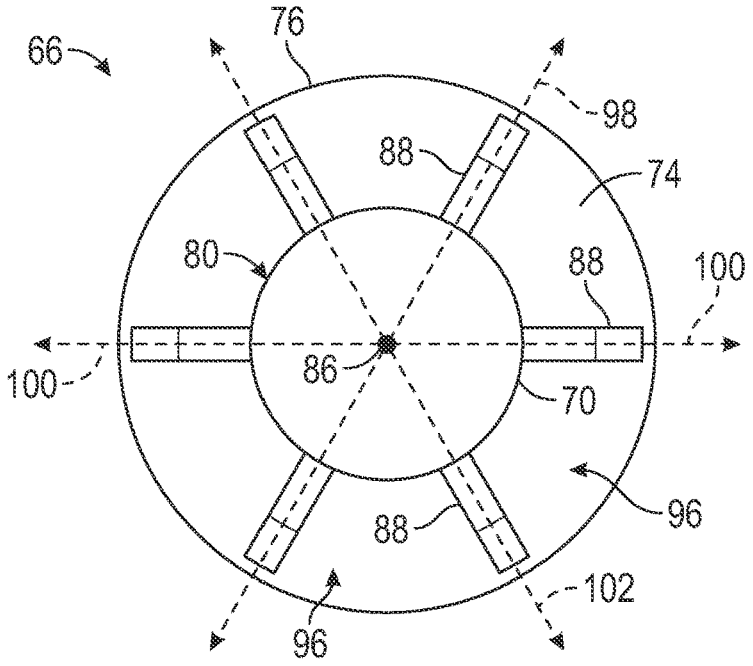
FIG. 8 illustrates a distal end view of the fastener shown in FIG. 5.

The protrusions may be interspaced with recessed portions 96 of the head 68 that may comprise the bearing surface 74 of the head 68. The recessed portions 96 may have a relatively lesser height than the protrusions in the distal direction and may extend between the circumferentially adjacent protrusions. FIG. 8, for example, illustrates a distal end view of the fastener 66. The grip features 88 are shown to be spaced circumferentially from each other about the longitudinal axis 86 of the shaft 70. The recessed portions 96 are positioned between each of the grip features 88 and alternate in position with the grip features 88.

As shown in FIG. 8, at least six grip features 88 may be utilized, although a greater or lesser number may be utilized in examples as desired (e.g., at least one, two, three, four, five, seven, eight, nine, etc.). The grip features 88 may be spaced circumferentially equal relative to each other as shown in FIG. 8, or may have a different spacing (e.g., unequal) relative to each other in examples.

The grip features 88 may extend radially outward from the longitudinal axis 86 and radially outward from the outer surface 80 of the shaft 70. The grip features 88, for example, may comprise ribs that may extend radially outward from the longitudinal axis 86 of the shaft 70 towards the outer edge 76 of the head 68.

Referring to FIG. 8, for example, the ribs may comprise elongate bodies that may protrude from the bearing surface 74 of the head 68. As shown in FIG. 8, each rib may extend in a respective plane 98, 100, 102 that the longitudinal axis 86 extends in. The ribs may be configured as spokes extending radially outward from the longitudinal axis 86.

Figure 9:
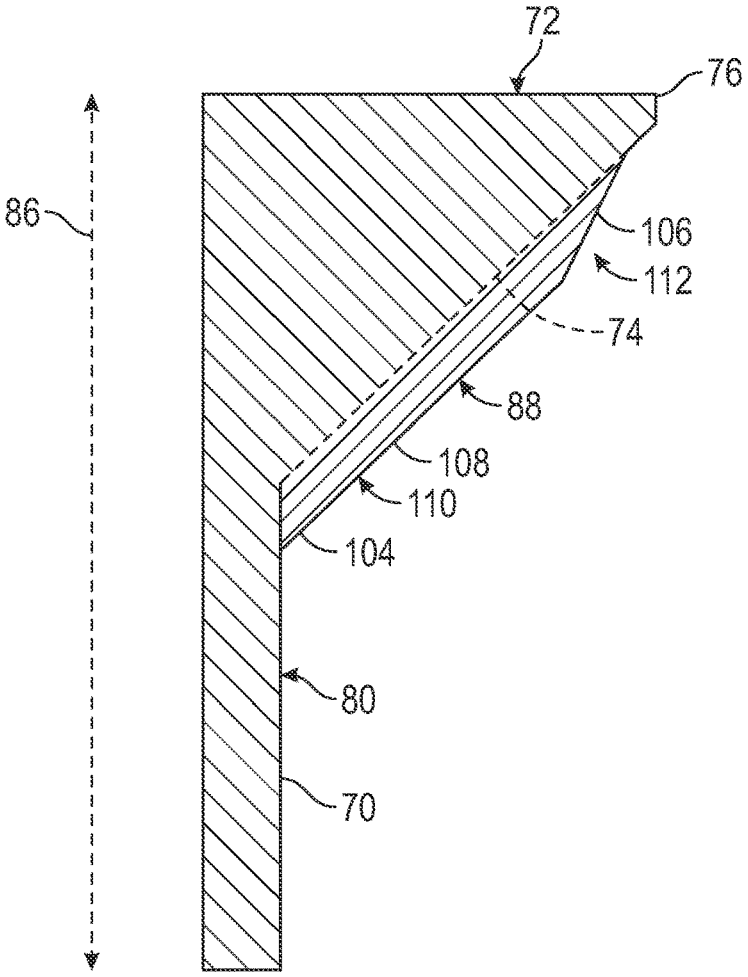
FIG. 9 illustrates a cross sectional schematic view of a portion of the fastener shown in FIG. 5 along line B-B in FIG. 7.
Figure 11:
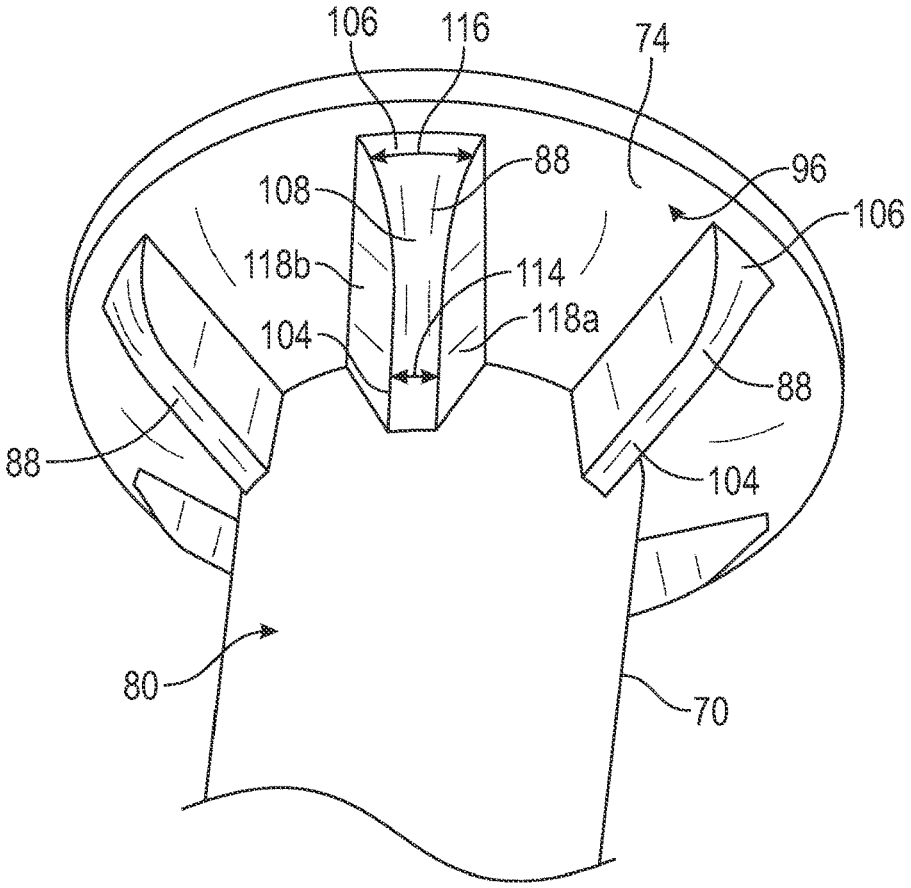
FIG. 11 illustrates a distal perspective view of the head of the fastener shown in FIG. 5.

Each grip feature 88 may include a radially inward portion 104 and a radially outward portion 106. FIG. 9, for example, illustrates a cross sectional view along line B-B in FIG. 7. The radially inward portion 104 is shown to contact the outer surface 80 of the shaft 70. FIG. 11, for example, further illustrates the radially inward portion 104 in contact with the outer surface 80 of the shaft 70. An outer surface of the radially inward portion 104 accordingly may be continuous with the outer surface 80 of the shaft 70 and may protrude radially outward from the outer surface 80 of the shaft 70.

Referring to FIG. 9, the grip feature 88 may extend radially outward to the radially outward portion 106, which may be positioned proximate the outer edge 76 of the top surface 72. Each grip feature 88 accordingly may span the bearing surface 74 from the outer surface 80 of the shaft 70 to the outer edge 76 of the top surface 72 in examples. In examples, each grip feature 88 may extend radially outward for a lesser proportion of the bearing surface 74 (e.g., less than three quarters of the radial distance, or less than half of the radial distance, among other distances for example).

Figure 10:
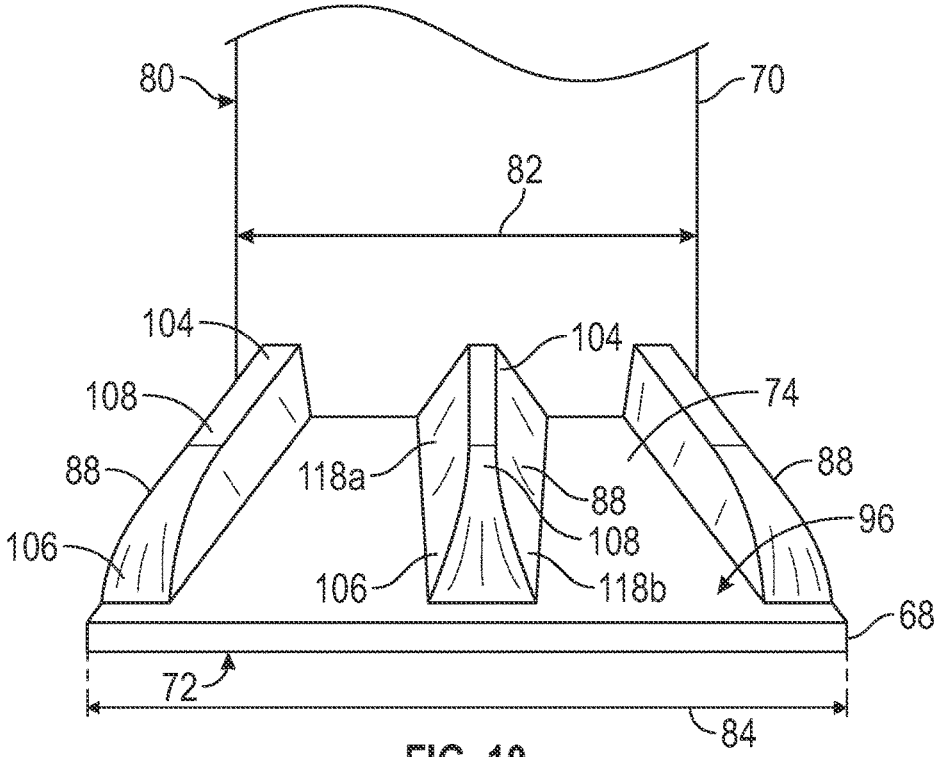
FIG. 10 illustrates a side view of the head of the fastener shown in FIG. 5.

FIG. 10 illustrates a side view of the head 68 of the fastener 66. Each grip feature 88 may include a distal surface 108 or leading surface that faces a distal direction. The distal surface 108 may comprise a peak or crest of the grip feature 88 that may have the greatest height relative to the bearing surface 74. The distal surface 108, in examples, may extend from the radially inward portion 104 to the radially outward portion 106 of the respective grip feature 88.

The distal surface 108 may comprise an angled portion (e.g., angled distally to form a sharp edge), or may comprise a rounded portion that may be rounded convex relative to the grip feature 88 as shown in FIG. 11 for example.

The distal surface 108 may be angled, and may be angled proximally from the radially inward portion 104 of the grip feature 88 towards the radially outward portion 106 of the grip feature 88. FIG. 9, for example, illustrates the angle of the distal surface 108 in a proximal direction from the radially inward portion 104 of the grip feature 88 towards the radially outward portion 106 of the grip feature 88.

In examples, the distal surface 108 may include a first portion 110 and a second portion 112. The first portion 110 may be positioned radially inward of the second portion 112 in examples. The first portion 110 may have a different angle than the second portion 112. For example, as shown in FIG. 9, the angle of the first portion 110 relative to a longitudinal axis 86 of the shaft 70 may be greater than the angle of the second portion 112 relative to the longitudinal axis 86. For example, the first portion 110 may be more perpendicular relative to the longitudinal axis 86 than the second portion 112.

In examples, the angle of the first portion 110 may match an angle of the bearing surface 74. For example, a same amount of taper may be utilized with the first portion 110 as the bearing surface 74 (e.g., 45 degrees or another angle as desired). The angle of the second portion 112 may differ to allow the distal surface 108 to intersect the bearing surface 74 or outer edge 76 of the head 68 as desired.

Referring to FIG. 11, in examples, a circumferential width of the distal surface 108 may increase from a radially inward portion 104 of the grip feature 88 towards the radially outward portion 106 of the grip feature 88. For example, as shown in FIG. 11, the circumferential width 114 at the radially inward portion 104 may be less than the circumferential width 116 at the radially outward portion 106. The radially inward portion 104 may comprise a leading portion of the grip feature 88 and accordingly a narrower distal surface 108 may increase the penetrating ability of the grip feature 88 initially. The radially outward portion 106 may comprise a tailing portion of the grip feature 88 that may penetrate the deck following the radially inward portion 104. The radially outward portion 106 may be positioned proximal of the radially inward portion 104. As such, the wider distal surface 108 at the radially outward portion 106 may serve to better hold the fastener in position following initial engagement by the radially inward portion 104.

Referring to FIG. 10, in examples, each grip feature 88 may include at least two side surfaces 118*a, b* that may extend from the distal surface 108 to the bearing surface 74. Each side surface 118*a, b* may be angled circumferentially outward from the distal surface 108 towards the bearing surface 74. As such, in examples, each grip feature 88 may comprise a wedge that may increase in width in a proximal direction. As the fastener 66 is moved distally into a hole of a deck 12, the width of the grip feature 88 applied to the deck 12 may increase, thus increasing the stability of the fastener 66 relative to the deck 12. Each grip feature 88 may have a triangular cross section when viewed transverse to the radial direction of the grip feature 88.

Each side surface 118*a, b* may reduce in height relative to the bearing surface 74 in a radially outward direction. Such a feature may account for the reduction of height of the distal surface 108 from the bearing surface 74 in a radially outward direction. For example, as shown in FIG. 11, the height of the side surfaces 118*a, b* may be greater at the radially inward portion 104 than at the radially outward portion 106.

The configuration of the grip features 88 and other features of the fastener 66 may be varied in examples. For example, the configuration of the grip features 88 may vary from the configuration shown in FIGS. 5-11 to include additional, modified, or fewer properties or features as desired. The configuration of the surfaces of the grip features 88 or other properties or features of the grip features may be varied in examples.

Figure 3:
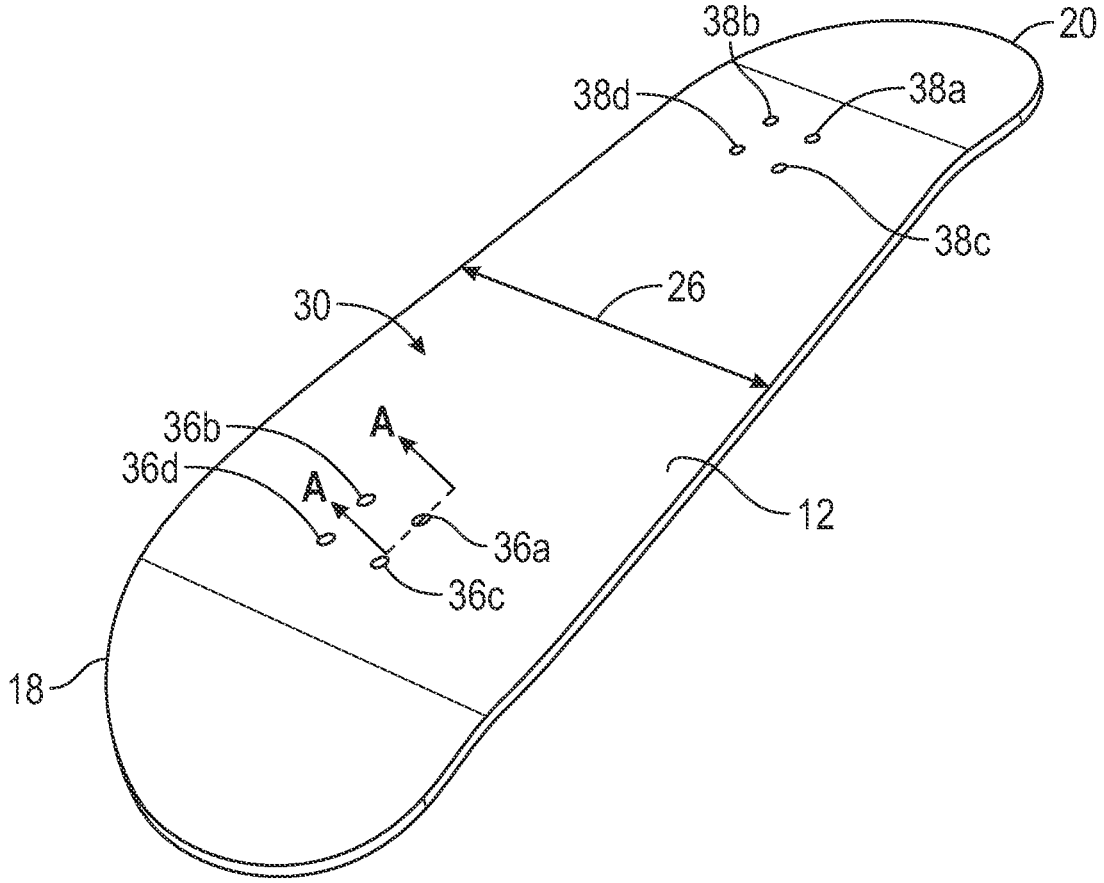
FIG. 3 illustrates a lower perspective view of a deck of a skateboard according to examples herein.

The fastener 66 may be utilized to couple the trucks 16*a, b* to the deck 12. Referring to FIG. 3, the fastener 66 may be passed through one of the holes 36*a-d*, 38*a-d* in the deck 12 in a direction towards the bottom surface 30 of the deck 12 (from the top surface 28 marked in FIG. 1). Multiple of the fasteners 66 may be passed through respective holes 36*a-d*, 38*a-d* as desired (as shown in FIG. 4) for coupling with respective trucks 16*a, b*.

As an example, FIG. 12 illustrates a cross sectional view of the deck 12 along line A-A in FIG. 3. The hole 36*a* of the deck 12 is shown to include a tapered bearing surface 40, although such taper may be excluded in examples (e.g., a planar bearing surface 40 or another shape of bearing surface as desired). In examples, a layer of the grip tape 32 may comprise a portion of the bearing surface 40, although such grip tape 32 may be excluded from the bearing surface 40 in examples if desired.

Figure 13:
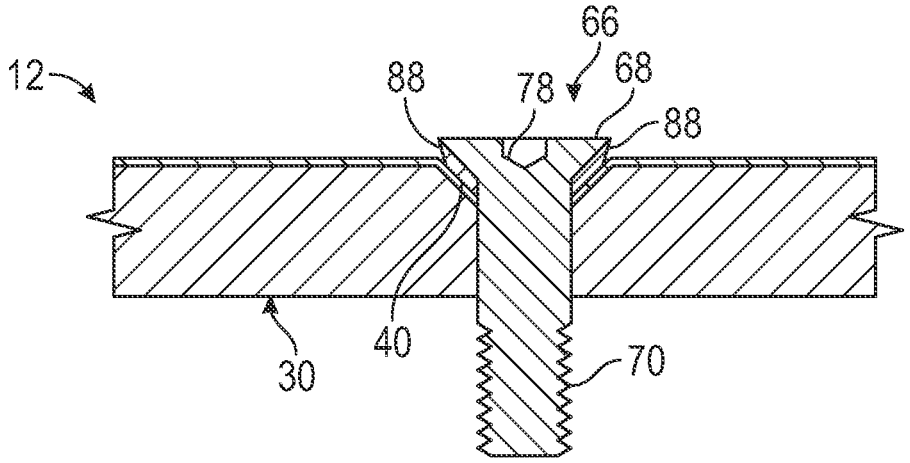
FIG. 13 illustrates a cross sectional schematic view of a deck along line C-C shown in FIG. 4.

The fastener 66 may be inserted into the hole 36*a* with the shaft 70 comprising a leading portion of the fastener 66. FIG. 13, for example, illustrates a view of the fastener 66 passed through the hole 36*a* with the shaft 70 protruding from the bottom surface 30 of the deck 12. FIG. 13 illustrates a view along line C-C in FIG. 4. The head 68 may be positioned on the top, upper, or proximal side of the deck 12 and the hole 36*a*. The shaft 70 may be passed through the hole 36*a* such that the grip features 88 may press against the deck 12. The grip features 88 may contact the bearing surface 40 of the deck 12, which may comprise the grip tape 32 or a surface of a board that the grip tape 32 is positioned on.

Notably, at this point in the fastening process, a tool such as a hex wrench or other form of tool would be engaged with the drive 78 of the fastener 66. Such tool would be used to prevent the circumferential rotation of the fastener 66 upon a securement body (e.g., a nut or other form of securement body) being engaged with the shaft 70 of the fastener 66.

Figure 14:
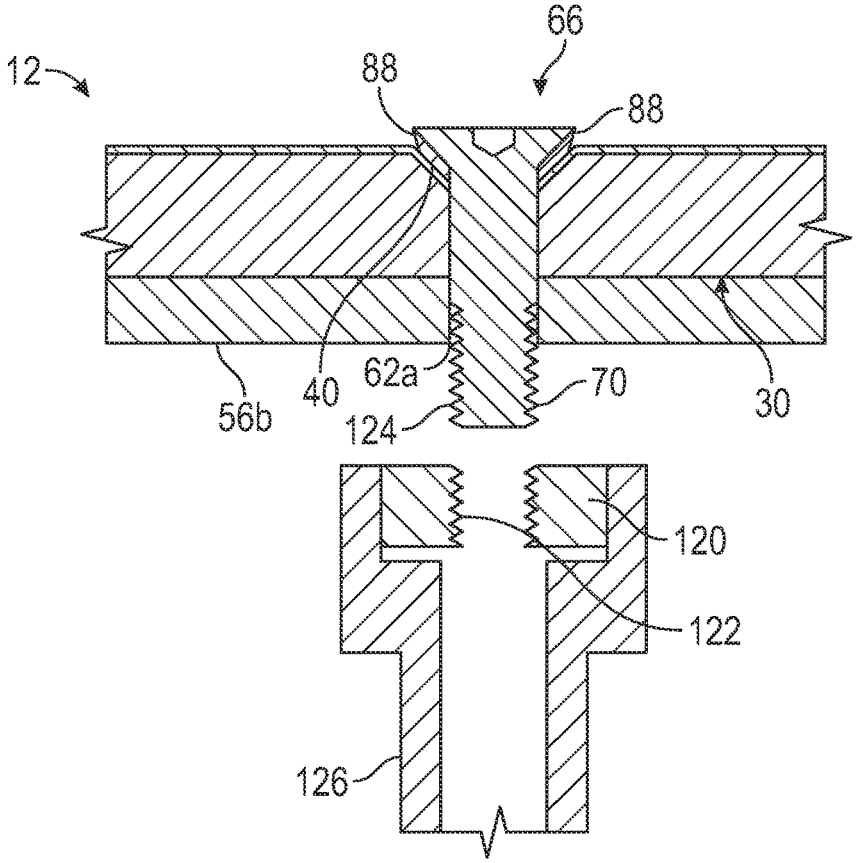
FIG. 14 illustrates a cross sectional schematic view of a securement body approaching a shaft of a fastener.
Figure 15:
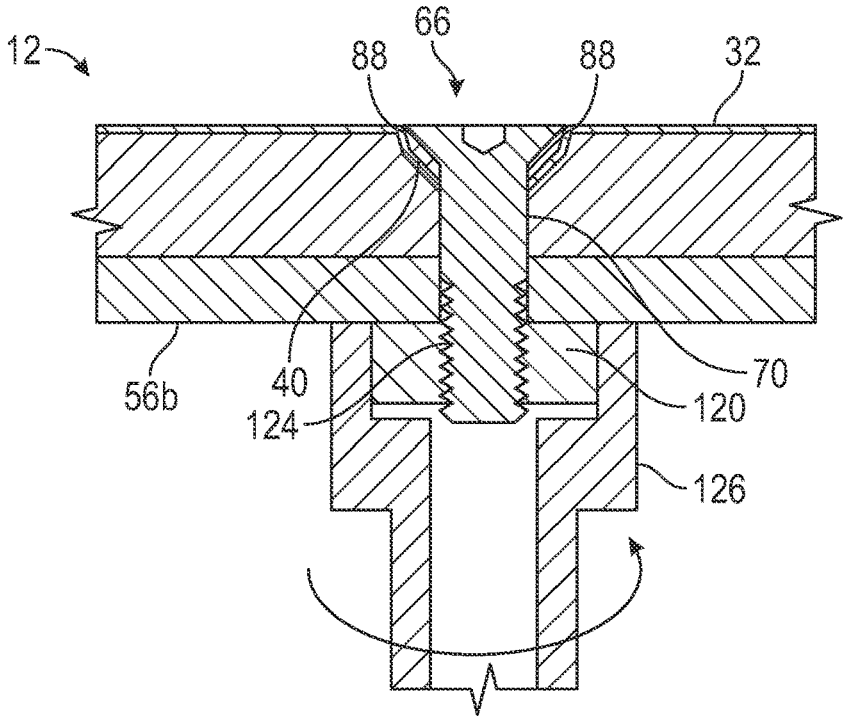
FIG. 15 illustrates a cross sectional schematic view of a securement body being rotated about a fastener.

However, the presence of the grip features 88 may reduce the need for a tool such as a hex wrench or other form of tool from engaging the drive 78. The grip features 88 may be placed against the bearing surface 40 of the deck 12 and may serve to grip the head 68 to the deck 12. The grip features 88 may be configured to reduce rotation of the head 68 relative to the hole 36*a* in the deck 12 for receiving the shaft 70. In addition, the use of a tool such as a hex wrench or other form of tool may be excluded in examples, as the grip features 88 may provide the securement force for the fastener 66 as the securement body (e.g., a nut or other form of securement body) is engaged with the fastener 66. FIGS. 14-16, for example, illustrate the fastener 66 secured in position without use of a tool such as a hex wrench or other form of tool from engaging the drive 78.

Referring to FIG. 14, for example, a base plate 56*b* of the truck 54*b* has been applied to the bottom surface 30 of the deck 12. The shaft 70 of the fastener 66 may be configured to pass through the hole 62*a* in the base plate 56*b* of the truck 16*b*.

A securement body 120 (e.g., a nut or other form of securement body) may engage with the engagement surface of the shaft 70. The securement body 120, for example, may include threading 122 that may engage with threading 124 of the shaft 70. A tool 126 (such as a nut driver, wrench, or other form of tool for engaging the securement body 120) may be utilized to rotate the securement body 120 onto the shaft 70. FIG. 14, for example, illustrates the tool 126 advancing the securement body 120 towards the shaft 70. One or more of the securement bodies 120 may engage the shaft 70 to tighten the head 68 to the deck 12.

At this point, the grip features 88 of the fastener 66 may contact the bearing surface 40 of the deck 12, yet may not fully penetrate or engage with the bearing surface 40. As such, a user (e.g. a rider or assembler of the skateboard) may contact the grip features 88 to the bearing surface 40 of the deck 12 manually or without use of a tool (e.g., a hammer or hex wrench or other tool that may be utilized with the head 68). In examples, the force of the securement body 120 pulling the fastener 66 distally through the holes 36*a*, 62*a* may cause the grip features 88 to contact the bearing surface 40.

The securement body 120 may be secured to the fastener 66, which may pull the fastener distally. The securement body 120 may be tightened to the shaft 70 to press the grip features 88 against the deck 12. Referring to FIG. 15, the tool 126, for example, may be rotated to cause the securement body 120 to rotate about the threading 124 of the shaft 70. The rotation of the securement body 120 may pull the fastener 66 in a distal direction.

The distal force upon the fastener 66 may cause the grip features 88 to engage the bearing surface 40 of the deck 12. The grip features 88, for example, may be pressed against the bearing surface 40 and may serve to reduce circumferential rotation of the fastener 66 as the securement body 120 is rotated relative to the shaft 70. In examples, the grip features 88 may deform one or more of the grip tape 32 or the board of the deck 12 to reduce the circumferential rotation of the fastener 66. For example, the grip features 88 may penetrate or otherwise engage one or more of the grip tape 32 or the board of the deck 12 to reduce the circumferential rotation of the fastener 66.

The surfaces of the grip features 88 discussed in regard to FIGS. 5-11, for example, may be configured to have an initial portion or leading portion (e.g., corresponding to the radially inward portions 104 of the grip features 88) that may have a relatively narrow surface area for penetration, which may enhance the ease of initial penetration of the bearing surface 40. The tailing portion of the surfaces (e.g., corresponding to the radially outward portion 106 of the grip features 88) may have a relatively wider surface area for additional securement of the grip features 88 as the securement body 120 is further tightened to the fastener 66. As such, resistance against circumferential rotation may be increased as the securement body 120 is further tightened and the fastener is drawn further in a distal direction.

Referring to FIG. 15, in examples, the grip features 88 may be configured to penetrate into the grip tape 32 without penetrating through the grip tape 32. As such, the gripping properties of the grip tape 32 may be used to further secure the fastener 66 in position. In examples, the grip features 88 may penetrate through the grip tape 32.

The securement body 120 may continue to be tightened to the fastener 66 until a desired amount of axial force couples the base plate 56*b* to the deck 12. FIG. 16, for example, illustrates the fastener 66 coupling the base plate 56*b* of the truck 16*b* to the deck 12. The top surface 72 of the head 68 may be flush with the top surface 28 of the deck 12.

A similar process may be utilized for the remaining fasteners 66 shown in FIG. 4, for example, to couple the trucks 16*a, b* to the deck 12.

Beneficially, the grip features 88 may reduce the need for a tool such as a hex wrench or other form of tool from engaging a drive 78 of the fastener 66 or otherwise engaging the head 68 of the fastener 66 while the fastener 66 is being secured to the skateboard. The grip features 88, for example, may allow a user (e.g., a rider or an assembler of the skateboard) to contact the grip features 88 to the bearing surface 40 of the deck 12 (which may be manually) and rotate the securement body 120 (e.g., a nut). The rotation of the securement body 120 may cause the grip features 88 to engage the bearing surface 40 and reduce the rotation of the fastener 66 while the securement body 120 is further tightened.

Figure 17:
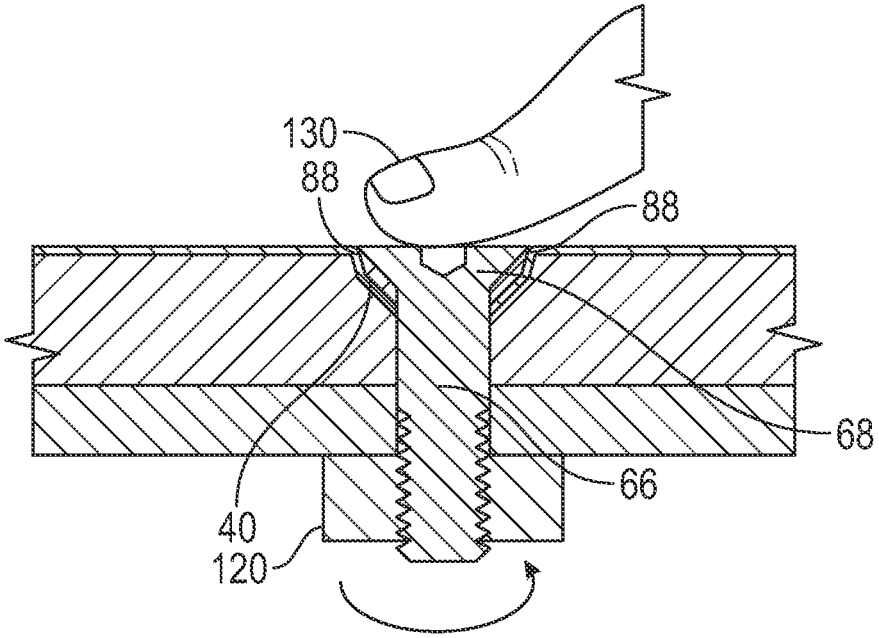
FIG. 17 illustrates a cross sectional schematic view of a portion of a body applied to a head of a fastener.

In examples, a user (e.g., a rider or assembler of the skateboard), may manually apply a finger 130 or other part of the body or another surface to the head 68 of the fastener 66 to aid in the contact of the grip features 88 to the bearing surface 40 as the securement body 120 is rotated. FIG. 17, for example, illustrates a finger 130 applied to the head 68 of the fastener 66. As such, a tool does not necessarily need to be used with the head 68 of the fastener 66.

For a rider of a skateboard, such a feature may beneficially reduce the amount of equipment that a rider needs to carry in the field while riding a skateboard. For example, if a rider by chance rips a truck loose while performing a trick or the like, the rider can beneficially rapidly reconnect the truck utilizing the fastener 66. The rider would not necessarily need a tool such as a hex wrench or other form of tool for engaging a drive 78 of the fastener 66 or otherwise engaging the head 68 of the fastener 66. Fewer tools would need to be carried by a rider.

In addition, a rider in the field could more rapidly swap out trucks or a deck of a skateboard without necessarily needing a tool for engaging a drive 78 of the fastener 66 or otherwise engaging the head 68 of the fastener 66.

Assemblers of a skateboard system, for example, may benefit. The use of the grip features 88 may increase the speed at which a skateboard could be assembled or modified in a factory setting or otherwise, as a tool for engaging a drive 78 of the fastener 66 or otherwise engaging the head 68 of the fastener 66 would not necessarily be needed. More rapid production or modification of a skateboard system may be provided.

In examples, the grip features 88 may be utilized to supplement the use of a tool for engaging a drive 78 of the fastener in examples (e.g., a tool may be utilized yet the grip features 88 may still aid to secure the fastener 66 in position).

The fasteners 66 may be provided solely (e.g, a single fastener or at least one fastener may be provided), or may be provided as a bundle of hardware for use with a skateboard system. For example, the fasteners 66 may be provided in groups of at least four (to pass through each of the respective holes 36*a-d* in the deck 12). In examples, the fasteners 66 may be provided in groups of at least eight (for eight holes 36*a-d*, 38*a-d* in the deck) or may be provided in a different number as desired. The fasteners 66 may be packaged and provided for users to modify existing skateboards by swapping out other forms of fasteners for the fasteners described herein. Other hardware such as the securement bodies 120 may be packaged and provided as well. Other hardware such as the securement bodies or washers or spacers for the wheels may be provided as well and packaged with at least one of the fasteners 66.

In examples, a skateboard system may be provided that may include at least one of the fasteners 66. The skateboard system may be provided as an assembled unit (including at least one of the fasteners 66 or having all fasteners comprise the fasteners 66 described herein) or may be provided as a set of components for forming a skateboard (e.g., for a user to assemble). Various components of a skateboard may be provided with at least one of the fasteners 66 (e.g., the fasteners 66 may be packaged and provided with the deck 12, or one or more of the trucks 16*a, b*, or with other components of the skateboard).

The fasteners may be utilized with a variety of forms of skateboard (e.g., cruisers, skate park boards, longboards, electric, and non-electric, among others). In examples, the fasteners may be utilized generally with sporting boards or board sports (e.g., scooters, waveboards, etc.), or other sports apparatuses, unless otherwise stated. The fasteners may be utilized with other components to be fastened unless otherwise stated.

For purposes of this description, certain aspects, advantages, and novel features of the examples of this disclosure are described herein. The disclosed methods, apparatuses, and systems should not be construed as limiting in any way. Instead, the present disclosure is directed toward all novel and nonobvious features and aspects of the various disclosed examples, alone and in various combinations and subcombinations with one another. The methods, apparatuses, and systems are not limited to any specific aspect or feature or combination thereof, nor do the disclosed examples require that any one or more specific advantages be present or problems be solved. Features, elements, or components of one example can be combined into other examples herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

Some examples have been described in connection with the accompanying drawings. Components can be added, removed, and/or rearranged. Further, the disclosure herein of any particular feature, aspect, method, property, characteristic, quality, attribute, element, or the like in connection with various examples can be used in all other examples set forth herein. Additionally, it will be recognized that any methods described herein may be practiced using any device suitable for performing the recited steps.

While a number of examples and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A skateboard system comprising:

a deck;

a plurality of wheels;

a plurality of trucks configured to support the plurality of wheels; and a plurality of fasteners configured to couple the plurality of trucks to the deck, at least one of the fasteners including a head and a shaft, the head including a bearing surface and one or more grip features configured to grip the head to the deck, the shaft configured to couple to one of the plurality of trucks.

2. The skateboard system of claim 1, wherein the one or more grip features are positioned on the bearing surface.

3. The skateboard system of claim 1, wherein the one or more grip features comprise one or more protrusions positioned on the bearing surface.

4. The skateboard system of claim 3, wherein the one or more protrusions comprise one or more ribs extending radially outward from a longitudinal axis of the shaft.

5. The skateboard system of claim 4, wherein each of the one or more ribs extends in a plane that the longitudinal axis of the shaft extends in.

6. The skateboard system of claim 1, wherein the bearing surface comprises a tapered surface.

7. The skateboard system of claim 1, further comprising one or more nuts for engaging the shaft to tighten the head to the deck.

8. The skateboard system of claim 1, wherein the shaft is configured to pass through a hole in a base plate of the one of the plurality of trucks.

9. The skateboard system of claim 1, wherein the one or more grip features are configured to reduce rotation of the head relative to a hole in the deck for receiving the shaft.

10. The skateboard system of claim 1, wherein the one or more grip features are configured to engage grip tape of the deck.

11. A skateboard fastener system comprising:

at least one fastener configured to couple a deck of a skateboard to a truck of the skateboard, the at least one fastener including a head and a shaft, the head including a bearing surface and one or more grip features configured to grip the head to the deck, the shaft configured to couple to the truck.

12. The skateboard fastener system of claim 11, wherein the one or more grip features comprise one or more protrusions positioned on the bearing surface.

13. The skateboard fastener system of claim 11, further comprising one or more nuts for engaging the shaft to tighten the head to the deck.

14. The skateboard fastener system of claim 11, further comprising at least four of the fasteners, each of the fasteners configured to pass through a respective hole in the deck to couple the deck to the truck.

15. The skateboard fastener system of claim 11, wherein the shaft has a proximal end coupled to the head and a distal end ending distally from the head, and each of the one or more grip features include a distal surface angled proximally from a radially inward portion of the respective one or more grip feature towards a radially outward portion of the respective one or more grip feature.

16. A method comprising:

providing at least one fastener configured to couple a deck of a skateboard to a truck of the skateboard, the at least one fastener including a head and a shaft, the head including a bearing surface and one or more grip features configured to grip the head to the deck, the shaft configured to couple to the truck.

17. The method of claim 16, further comprising passing the shaft through a hole in the deck such that the one or more grip features press against the deck.

18. The method of claim 17, further comprising tightening a securement body to the shaft to press the one or more grip features against the deck.

19. The method of claim 16, wherein the one or more grip features are configured to reduce rotation of the head relative to a hole in the deck for receiving the shaft.

20. The method of claim 16, wherein the one or more grip features comprise one or more protrusions positioned on the bearing surface.

* * * * *